US005579091A

United States Patent [19]

Yamada et al.

[11] Patent Number: 5,579,091

[45] Date of Patent: Nov. 26, 1996

[54] DEVELOPING UNIT FOR ELECTRO-PHOTOGRAPHIC APPARATUS

[75] Inventors: Koutarou Yamada, Hitachinaka; Youji Hirose, Mito; Hiroshi Ueno, Hitachinaka; Isao Watanabe, Hitachinaka; Yoshio Ogura, Hitachinaka; Katuhiro Shinohara, Hitachinaka; Kouhei Katayama, Hitachinaka; Minoru Murase, Hitachinaka, all of Japan

[73] Assignee: Hitachi Koki Co., Ltd., Tokyo, Japan

[21] Appl. No.: 397,882

[22] Filed: Mar. 2, 1995

[30] Foreign Application Priority Data

Mar. 4, 1994 [JP] Japan ..... 6-034643

[51] Int. Cl.[6] ..... G03G 15/06

[52] U.S. Cl. ..... 355/208; 355/246

[58] Field of Search ..... 355/208, 246

[56] References Cited

U.S. PATENT DOCUMENTS 4,870,460 9/1989 Harada et al. ..... 355/246
5,504,557 4/1995 Morita et al. ..... 355/208

FOREIGN PATENT DOCUMENTS 57-116370 7/1982 Japan .

*Primary Examiner*—Nestor R. Ramirez
*Attorney, Agent, or Firm*—Antonelli, Terry, Stout & Kraus

[57] ABSTRACT

When a developing agent prepared to have a preset toner density is loaded in a developing unit, a comparing reference level for controlling the toner density in the developing agent is changed to a value higher than the preset value in the initial stage of operation and fresh toner is supplied to the developing agent so that the toner density of the developing agent is increased in comparison to the reference level. Thereby, the developed density is prevented from decreasing due to an excess amount of friction charge of the toner.

9 Claims, 7 Drawing Sheets

DEVELOPING UNIT FOR ELECTRO-PHOTOGRAPHIC APPARATUS

BACKGROUND OF THE INVENTION

The present invention relates to a developing unit for an electro-photographic apparatus.

A developing agent commonly used in a developing unit for electro-photographic apparatus consists of a mixture of a toner of ink powder and a carrier frictionally charging the toner. The toner density (mixing ratio of toner and carrier) of the developing agent is controlled so as to be maintained at a preset value corresponding to the specification of the electro-photographic apparatus in which the developing agent is to be used.

The toner density of the developing agent being used is different depending on the characteristic of electro-photographic apparatus. For example, the toner density of a developing agent required for developing a given electro-static latent image with a given developed density is low in a developing unit having a high developing capability. Therefore, in an electro-photographic apparatus, a developing agent is used having a toner density (for example, 3%) determined in accordance with the electric potential characteristic of the electro-static latent image formed by the latent image forming unit and the developing characteristic of the developing unit. The toner density the developing agent is decreased with consumption of toner which attaches to the electro-static latent image. In a common developing unit, the developed density decreases as the toner density of the developing agent decreases. Therefore, such a developing unit has a toner density sensor for detecting the toner density of the developing agent, a comparator for judging whether the toner density is high or low by comparing the toner density detected by the toner density sensor with a predetermined reference level, and a toner supplying unit for supplying fresh toner from a toner hopper to the developing agent corresponding to the judged result.

FIG. 7 shows characteristics of the toner supplying operation in a conventional common electro-photographic apparatus. The toner density of the developing agent detected by the toner density sensor is compared with a preset reference level, and if the toner density is decreased to a level lower than the reference level with consumption of the toner in the developing agent, new toner is supplied to keep the toner density at a certain density (for example, 3%).

As a parameter of the developing agent which is a indicator of the developed density, there is the amount of friction charge of the toner due to the carrier. In a conventional toner density control method having a target value of a fixed normal reference level, as shown in FIG. 8, the amount of friction charge of the toner excessively increases in the initial stage of loading a fresh developing agent prepared to meet the reference level as shown in FIG. 9, and the developed density is apt to decrease as shown in FIG. 10. Since the friction charge characteristic of a fresh developing agent varies depending on the condition of preparation of the toner and carrier such as the characteristic of the developing unit, the moisture control of the environment and so on, it has been difficult to stabilize the developed density of the developing unit loaded with a fresh developing agent prepared in to have a given toner density.

SUMMARY OF THE INVENTION

An object of the present invention is to provide a developing unit for an electro-photographic apparatus which is capable of developing an electro-static latent image with a stable developed density even when a fresh developing agent is prepared with a preset toner density.

Another object of the present invention is to provide a developing unit for an electro-photographic apparatus which is capable of developing an electro-static latent image with a high developed density even when a fresh developing agent is prepared with a preset toner density.

The feature of the present invention is that, when a developing agent prepared with a preset toner density is loaded in a developing unit, a comparing reference level for controlling the toner density in the developing agent is changed to a value higher than the preset value in the initial stage, and a fresh toner is supplied to the developing agent, so that the toner density of the developing agent is increased in comparison to the reference level. Thereby, the developed density is prevented from decreasing due to an excess amount of friction charge of the toner.

DETAILED DESCRIPTION OF THE PREFERRED EMBODIMENTS

Figure 1:
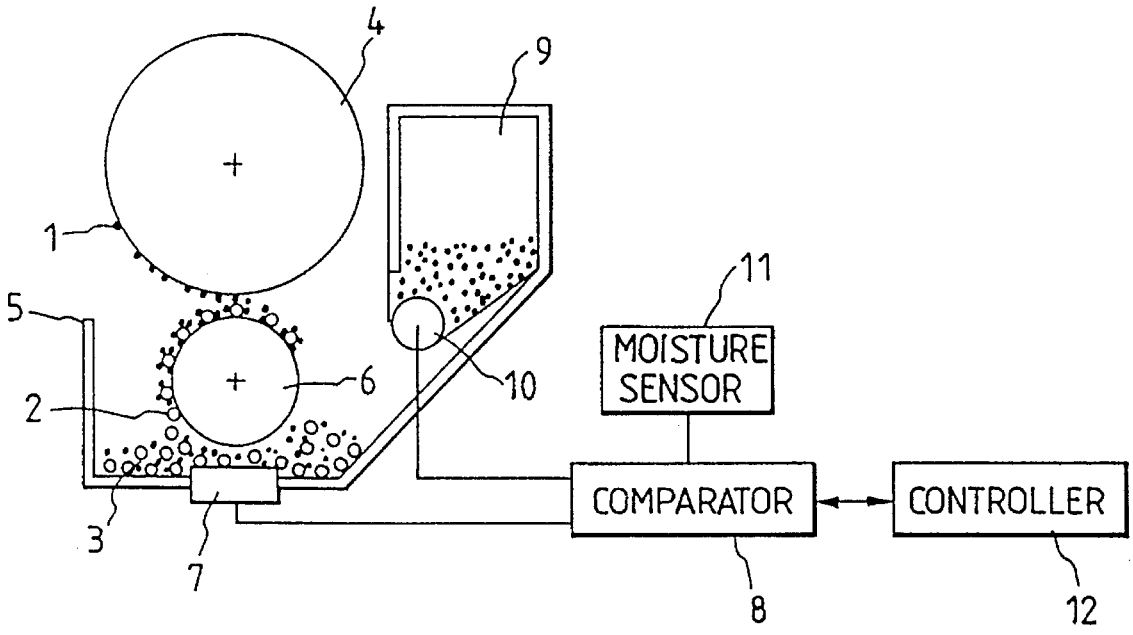
FIG. 1 is a schematic diagram showing one embodiment of a developing unit an electro-photographic apparatus in accordance with the present invention.

A developing unit for an electro-photographic apparatus according to the present invention has, as shown in FIG. 1, a developing agent 3 consisting of a mixture of toner 1 and carrier 2, a photosensitive drum 4 for forming an electro-static latent image, a developing container 5 for containing a developing roll 6 to which said developing agent 3 adheres, a toner density sensor 7 for detecting the toner density of the developing agent 3 contained in the developing container 5, a comparator 8 for comparing a detected toner density signal output from the toner density sensor 7 with a comparing reference signal corresponding to a target toner density value, a toner hopper 9 containing fresh toner, a toner supplying unit 10 for supplying the toner in the toner hopper 9 to the developing container 5, a moisture sensor 11 for detecting the moisture of the environment, and a controller 12 for controlling the overall electro-photographic apparatus and supplying printing speed information, developing unit operating information and developing agent loading information to the comparator 8. The developing agent loading information is formed so as to correspond to the operating period from the time when the fresh developing agent 3 is loaded in the developing container 5, the number of printed sheets and so on. In this embodiment, an initial stage is defined as the duration or period from the time when the fresh developing agent 3 is loaded in the developing container 5 to the time when about a half of the amount of the loaded developing agent is consumed. The length of said period defined as the initial stage is a value varying depending on the printing speed of the electro-photographic apparatus and the moisture content of the environment at the operating time.

The comparator 8 has a function to set the comparing reference value (the target value for toner density control) based on the printing speed information, the developing unit operating information and the developing agent loading information, supplied from the controller 12, and the detected moisture information supplied from the moisture sensor 11. In the initial stage, when the fresh developing agent 3 is loaded into the developing container 5, the comparing reference value is changed to a value higher than the normal reference value corresponding to the preset toner density in the developing unit. Then, at the time when the initial stage elapses, the comparing reference value is changed again so as to be returned to the normal reference value.

Figure 2:
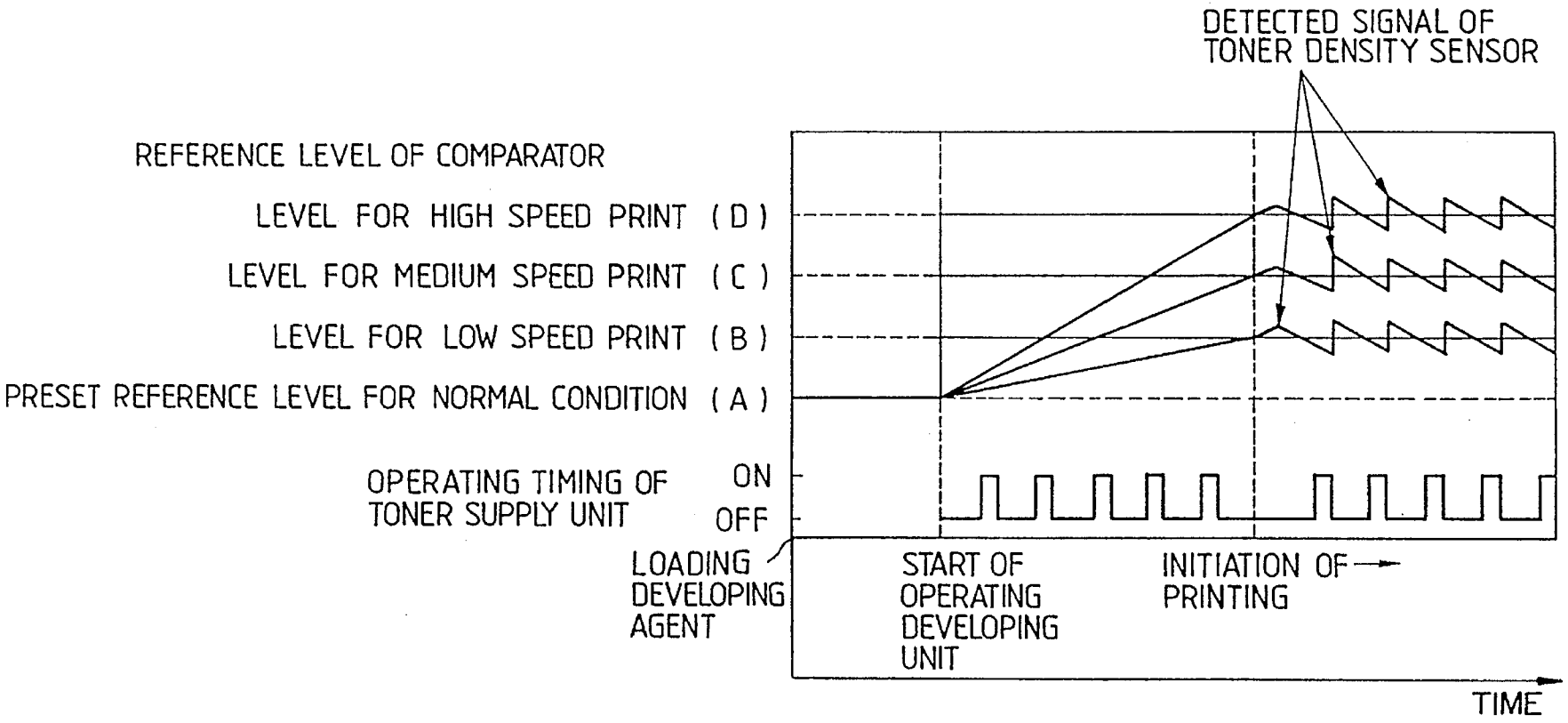
FIG. 2 is a chart showing the toner density control characteristic responding to the speed of printing in a developing unit for an electro-photographic apparatus in accordance with the present invention.
Figure 3:
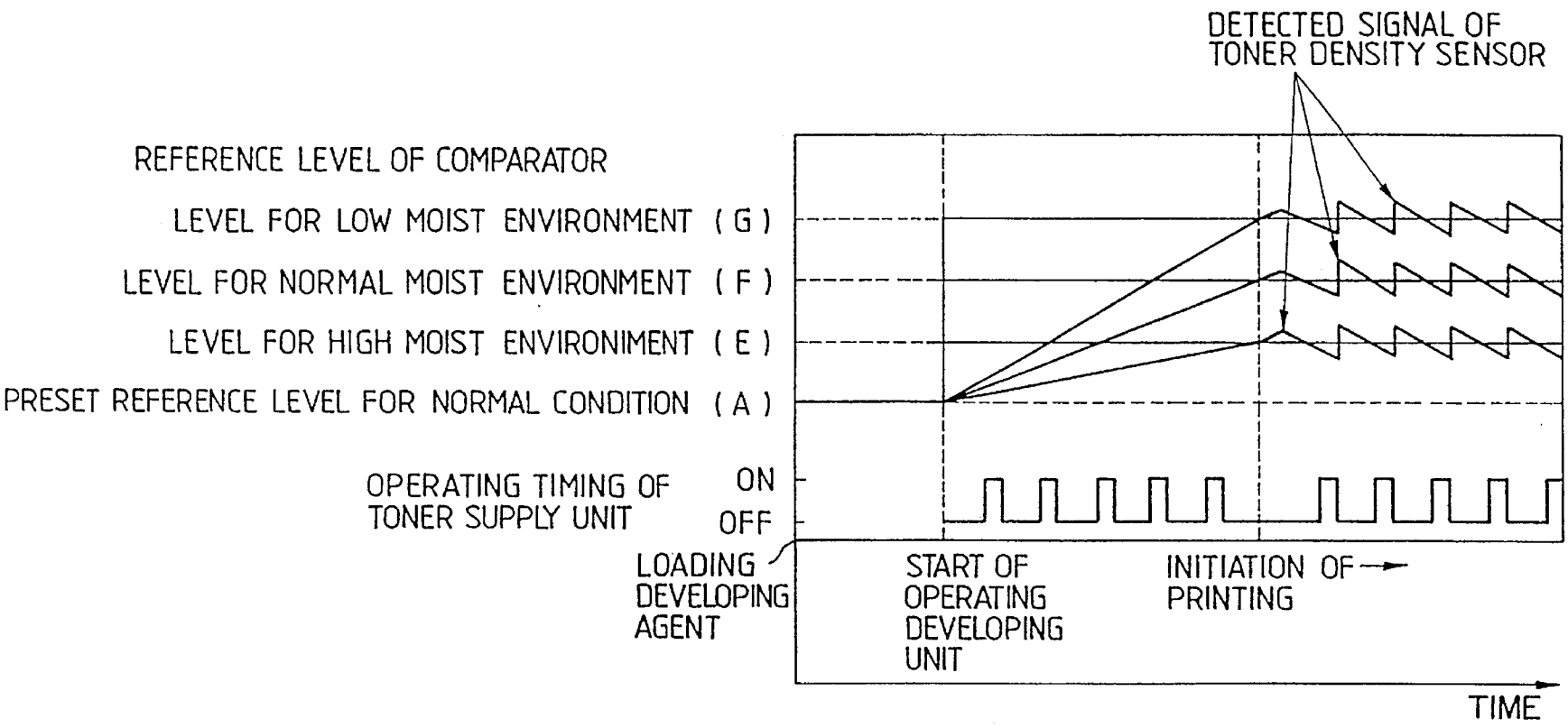
FIG. 3 is a chart showing the toner density control characteristic according to the moisture of the environment in a developing unit for an electro-photographic apparatus in accordance with the present invention.

As for the speed of printing, the changed value of the comparing reference value is preferably changed to a higher value as the speed of printing becomes higher, as shown in FIG. 2. As for the moisture content of the environment, the changed value of the comparing reference value is preferably changed to a higher value as the moisture content of the environment becomes lower, as shown in FIG. 3.

Figure 4:
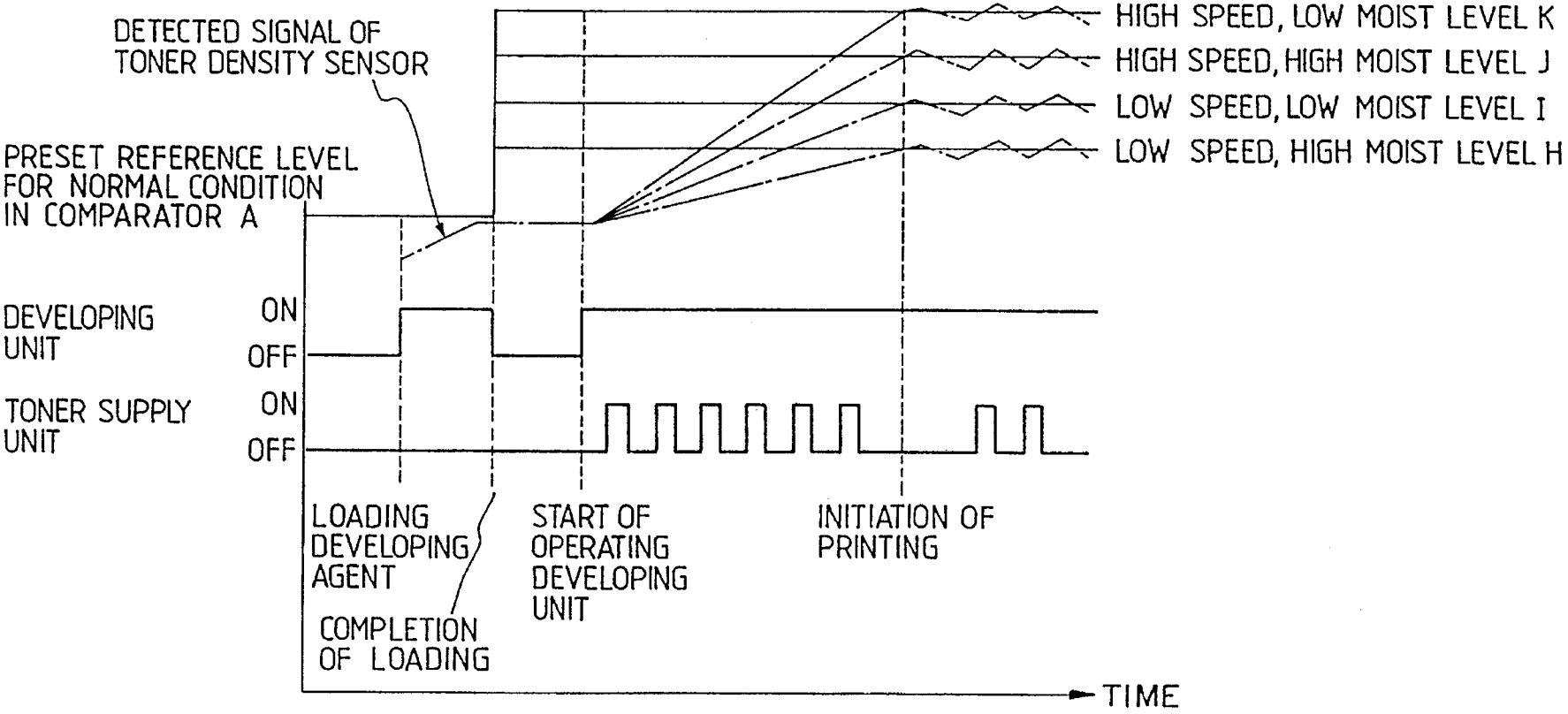
FIG. 4 is a chart showing the toner density control characteristic according to the speed of printing and the moisture of the environment in a developing unit for an electro-photographic apparatus in accordance with the present invention.

In order to realize a preferable characteristic as described above, the comparator 8 in this embodiment changes the value according to the following groups: low speed and high moisture, low speed and low moisture, high speed and high moisture, high speed and low moisture, in the initial stage of loading a fresh developing agent 3. The comparator 8 has comparing reference signal generating means for selectively generating the comparing reference signals of a preset reference level for normal condition A, a comparing reference level at low speed and high moisture condition H, a comparing reference level at low speed and low moisture condition I, a comparing reference level at high speed and high moisture condition J, and a comparing reference level at high speed and low moisture condition K, as shown in FIG. 4.

Figure 5:
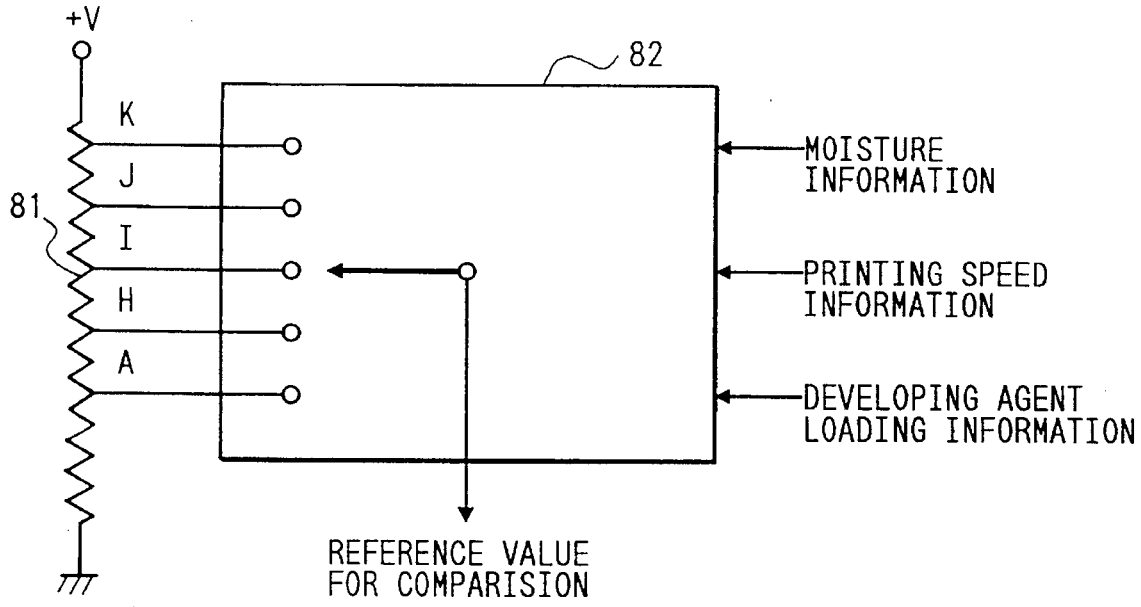
FIG. 5 is a block diagram showing a comparator in a developing unit for an electro-photographic apparatus in accordance with the present invention.

The comparing reference signal generating means of such type can be constructed, as shown in FIG. 5, with a signal voltage generating unit 81 for generating respective reference signal voltages corresponding to the preset reference level for normal condition A, the comparing reference level at low speed and high moisture condition H, the comparing reference level at low speed and low moisture condition I, the comparing reference level at high speed and high moisture condition J, and the comparing reference level at high speed and low moisture condition K, and a logical circuit 82 operating so as to selectively output one of the reference signal voltages based on the printing speed information, the environment moisture information and the developing agent loading information. The logical circuit 82 is practically realized with a selection circuit combining semiconductor logical elements.

This comparator 8 generates a permission signal for permitting the initiation of printing when the toner density in the developing agent 3 reaches the comparing reference value and is in a preferable state for the developing characteristic. Whether or not the toner density in the developing agent 3 is in a preferable state for the developing characteristic is known by monitoring the large-and-small relationship between the detected toner density signal and the comparing reference value.

Similar to a common electro-photographic apparatus, an electro-static latent image is formed on the surface of the photosensitive drum 4 by uniform charging and exposing. The developing roll 6 forms a magnetic brush by rotating and attracting the developing agent 3 accumulated in the developing container 5, and the electro-static latent image is formed by brushing the surface of the photosensitive drum 4 with the magnetic brush.

The developing agent 3, of which the toner is consumed by developing the electro-static latent image, is recovered from the developing roll 6 into the developing container 5, and mixed inside the developing container to be attached to the developing roll 6 again. The toner density sensor 7 generates a toner density signal having a magnitude proportional to the toner density in the developing agent 3 which is recovered and mixed in the developing container 5. The comparator 8 compares the preset comparing reference value (the target toner density value) and the detected toner density signal based on the printing speed information, the developing unit operating information and the detected toner density signal, and supplies fresh toner from the toner hopper 9 into the developing container 5 by driving the toner supplying unit 10 when the toner density in the developing agent 3 is below the comparing reference value. Supplying of the fresh toner is repeated until the toner density in the developing agent 3 recovers to the comparing reference value.

Figure 6:
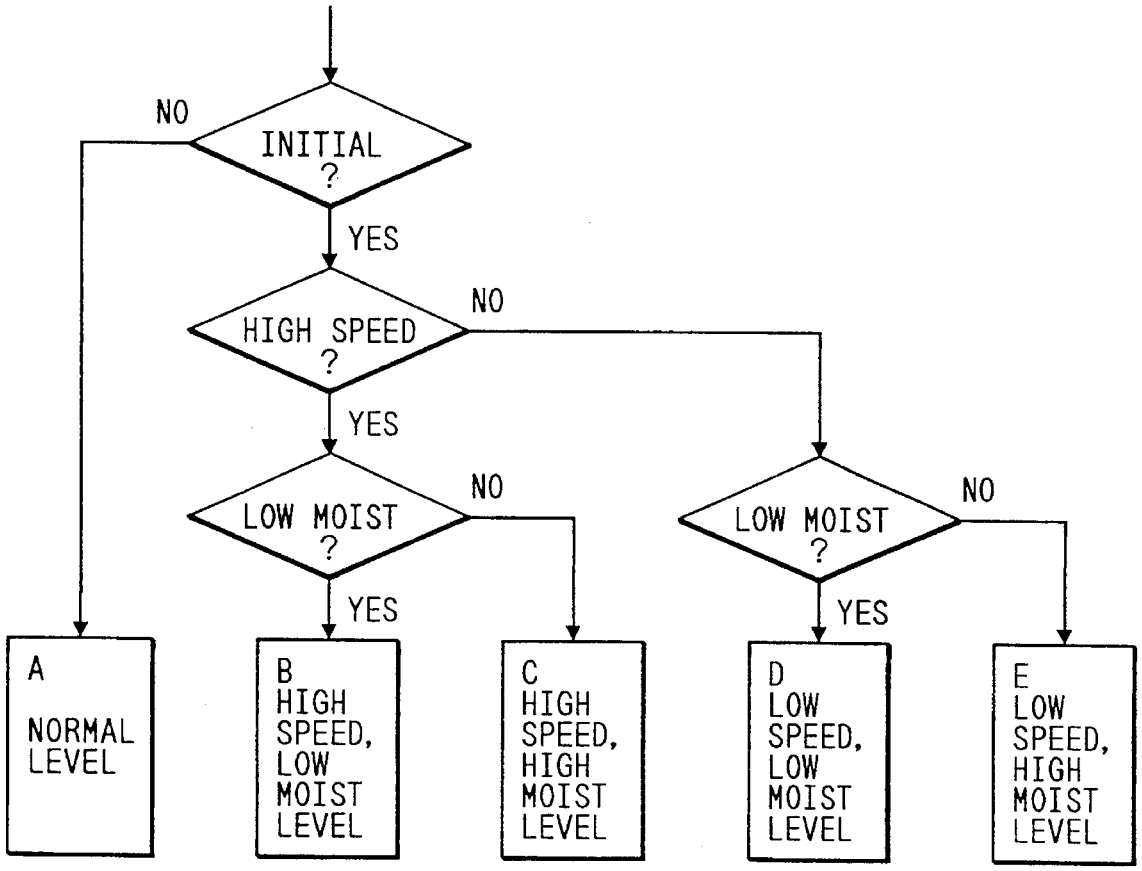
FIG. 6 is a flow chart showing the toner density reference level control executed by a comparator in the developing unit shown in FIG. 1.
Figure 7:
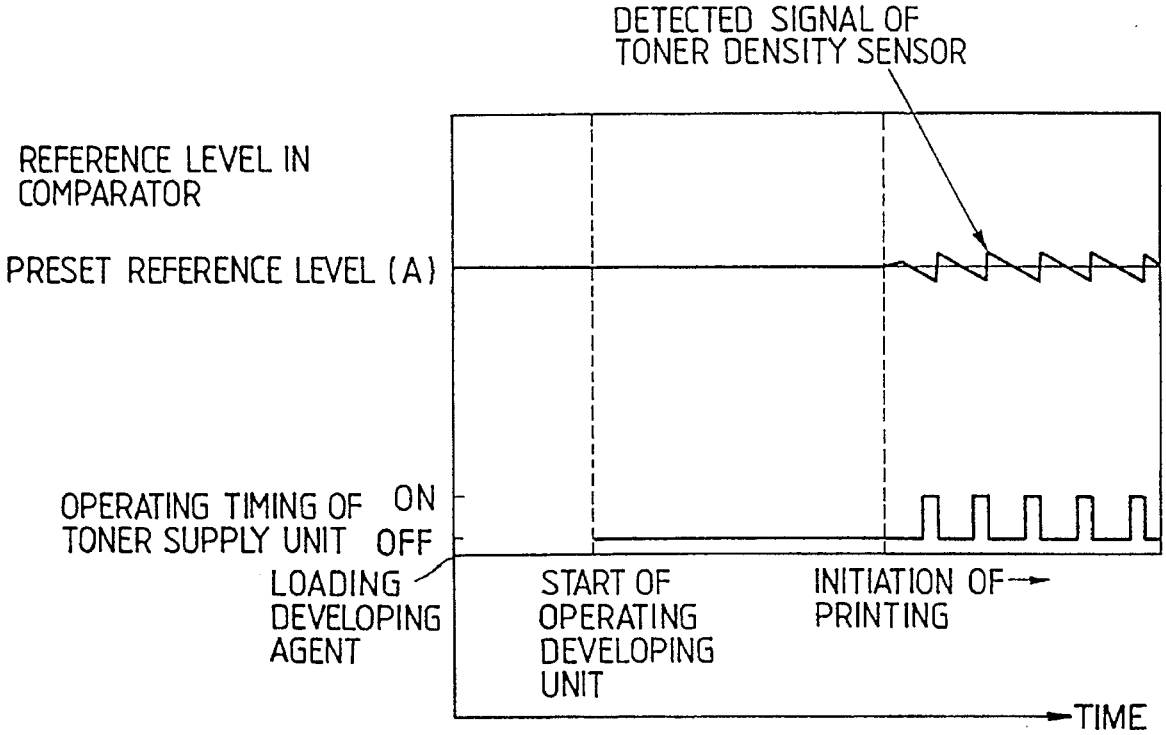
FIG. 7 PRIOR ART
FIG. 7 is a chart showing the toner density control characteristic in a conventional developing unit for an electro-photographic apparatus.
Figure 8:
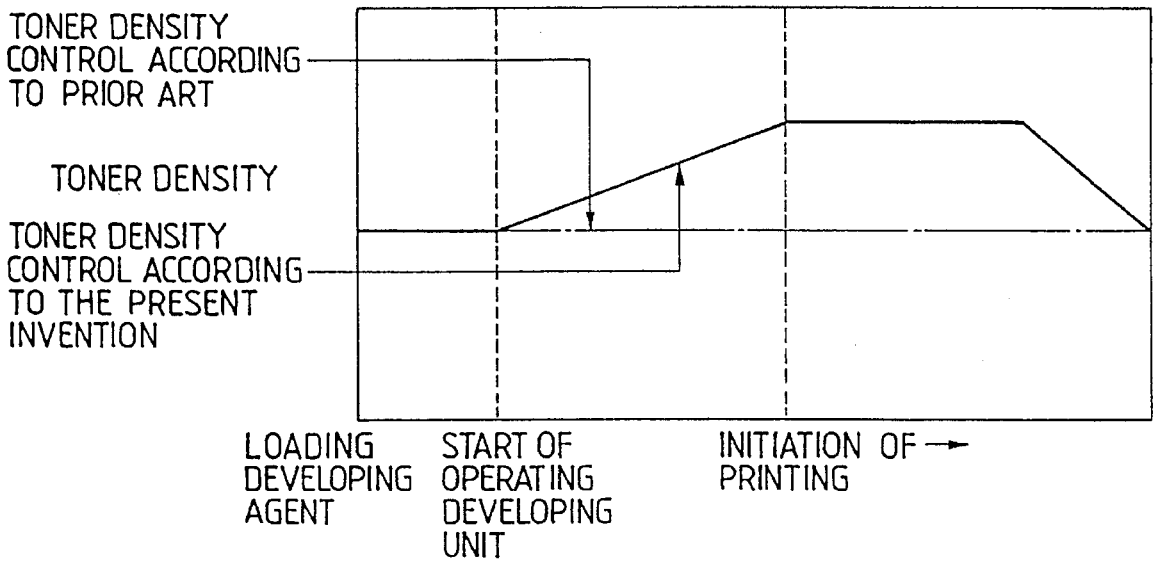
FIG. 8 is a chart explaining the toner density control characteristic in a developing unit in accordance with the present invention in comparison with the toner density control characteristic in a conventional developing unit.

As shown in FIG. 6, the logical circuit 82 for selecting the comparing reference value to be used confirms whether it is in the initial stage of loading the fresh developing agent by checking the developing agent loading information, and selects the comparing reference value A of the preset normal value if the initial stage elapses. If it is in the initial stage, the logical circuit confirms whether the speed of printing is high speed or not by checking the printing speed information, and then confirms whether the moisture content of the environment is low or high if it is high speed printing. And, if there is a low moisture content, the logical circuit selects the comparing reference value K for high speed and low moisture content. If there is a high moisture content, the logical circuit selects the comparing reference value J for high speed and high moisture content. In a case of the high speed of printing, the logical circuit selects the comparing reference value I for low speed and low moisture content, if the moisture content of the environment is low. If there is a high moisture content, the logical circuit selects the comparing reference value H for low speed and high moisture content.

As shown in FIG. 4, when fresh developing agent 3 is loaded into the developing container 5, a selecting operation for changing the comparing reference values as described above is performed, and when the developing unit is started, a toner supplying control based on the target value of said comparing reference value is carried out so as to perform developing using the developing agent 3 adjusted to the comparing reference value before the initiation of printing. The timing for generating a print starting permission signal is preferably delayed until the value of the detected toner density signal output from the toner density sensor 7 reaches the changed comparing reference value.

The controller 12 starts to control the printing operation of the electro-photographic apparatus when it receives the print starting permission signal from the comparator 8. Since the amount of friction charge of the toner does not become excessive, as shown in FIG. 9, as a result of the adjusting of the toner density in the developing agent 3 in such a manner, the electro-static latent image can be developed with a high density from the time of printing initiation, as shown in FIG. 10.

Figure 9:
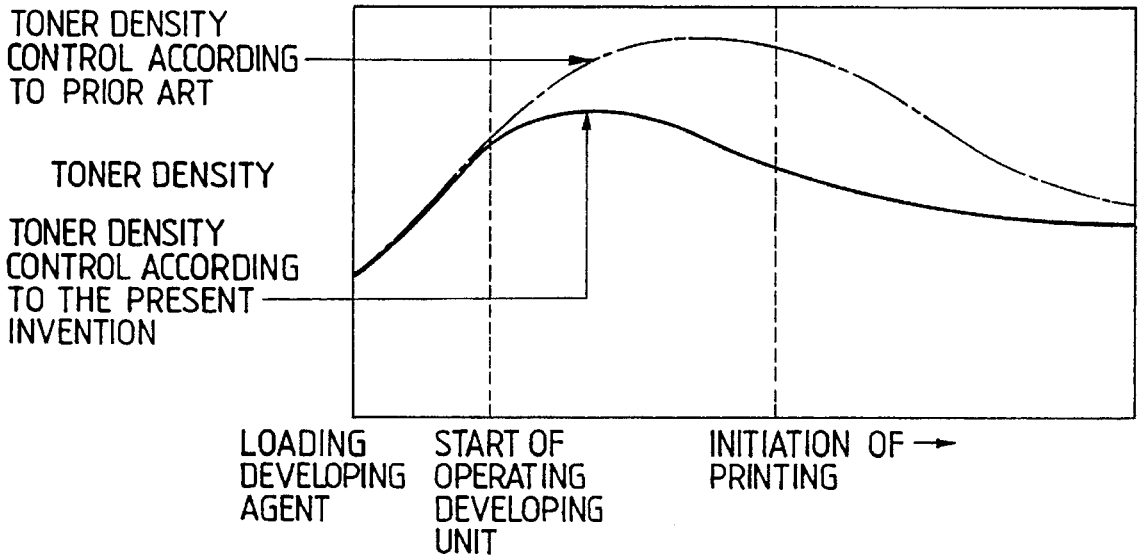
FIG. 9 is a chart explaining the friction charge characteristic of toner in a developing unit in accordance with the present invention in comparison with the friction charge characteristic of toner in a conventional developing unit.
Figure 10:
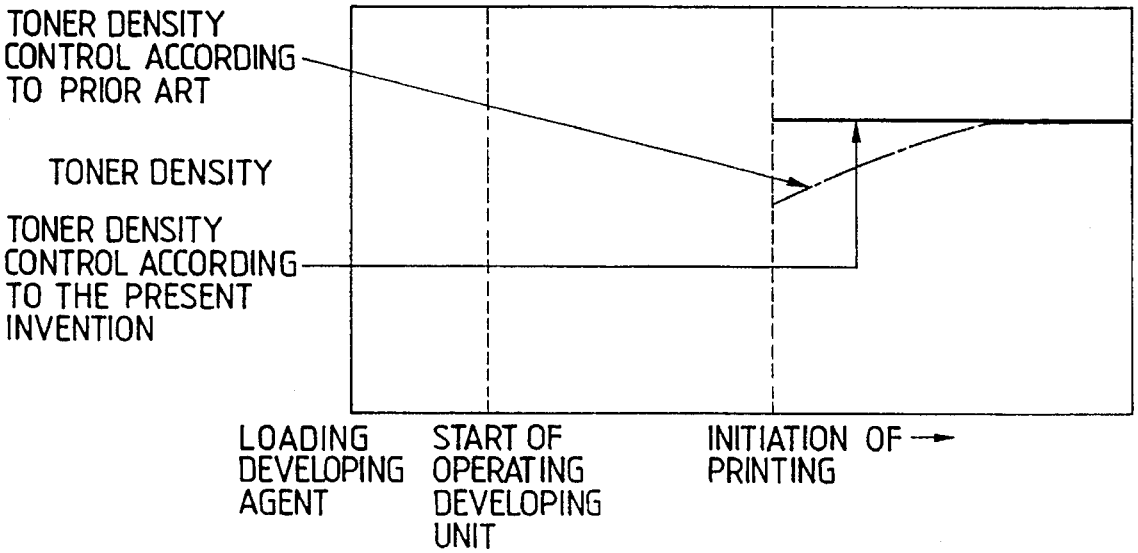
FIG. 10 is a chart explaining the developed density characteristic in a developing unit in accordance with the present invention in comparison with the developed density characteristic in a conventional developing unit.

As the time of use of the developing agent 3 passes, the amount of friction charge of the toner decreases, as shown in FIG. 9. Therefore, the comparator 8 checks the developing agent loading information supplied from the controller 12. If the state of the developing agent 3 has passed the initial stage, the toner supplying is switched to such a control that the toner density in the developing agent 3 becomes the preset normal toner density.

What is claimed is:

1. A developing unit for an electro-photographic apparatus having a developing agent in the form of a mixture of toner and carrier having a preset toner density, a toner density sensor for detecting the toner density of the developing agent, a comparator for comparing the detected toner density signal output from the toner density sensor with a comparing reference value, and a toner supplying unit for supplying toner to said developing agent based on a comparing result produced by said comparator, wherein:

said comparator comprises reference value changing means for changing said comparing reference value to a value higher than a preset normal reference value in an initial stage of use of said developing agent, so as to control the toner density of the developing agent to have a toner density higher than said preset toner density in said initial stage of use of said developing agent before initiation of printing.

2. A developing unit for an electro-photographic apparatus according to claim 1, wherein:

said comparator generates plural kinds of comparing reference values corresponding to the speed of printing and the moisture content of the environment.

3. A developing unit for an electro-photographic apparatus according to claim 1, wherein:

said comparator generates a comparing reference value such as to increase the toner density as the speed of printing increases.

4. A developing unit for an electro-photographic apparatus according to claim 1, wherein:

said comparator generates a comparing reference value such as to increase the toner density as the moisture content of the environment decreases.

5. A developing unit for an electro-photographic apparatus having a developing agent in the form of a mixture of toner and carrier having a preset toner density, a toner density sensor for detecting the toner density of the developing agent, a comparator for comparing the detected toner density signal output from the toner density sensor with a comparing reference value, and a toner supplying unit for supplying toner to said developing agent based on a comparing result produced by said comparator, wherein:

said comparator comprises reference value changing means for changing said comparing reference value to a value higher than a preset normal reference value in an initial stage of use of said developing agent and for returning the comparing reference to a reference value corresponding to the preset toner density after elapse of the initial stage, so as to control the toner density of the developing agent to have a toner density higher than said preset toner density in said initial stage of use of said developing agent before initiation of printing.

6. A developing unit for an electro-photographic apparatus according to claim 5, wherein:

the amount of change of said reference value by said reference value changing means is different depending on the speed of printing.

7. A developing unit for an electro-photographic apparatus according to claim 5, wherein:

the amount of change of said reference value by said reference changing means is different depending on the moisture content of the environment.

8. A developing unit for an electro-photographic apparatus according to claim 5, wherein:

said initial stage of use of said developing agent is a period from the time when said developing agent having a preset toner density is supplied in said electro-photographic apparatus to the time when about a half of the amount of the loaded developing agent is consumed.

9. A developing unit for an electro-photographic apparatus according to claim 5, wherein:

the period of said initial stage of use of said developing agent depends on the printing speed of the electro-photographic apparatus and the moisture content of the environment; and the amount of change of said reference value is varied by said reference value changing means in accordance with the period of said initial stage.

* * * * *